United States Patent [19]

Tracy

[11] Patent Number: 5,001,977

[45] Date of Patent: Mar. 26, 1991

[54] TRASH COMPACTOR ADAPTED TO BE SLIDABLY POSITIONED IN A CONTAINER

[76] Inventor: Thomas R. Tracy, 2175 Fairmeadow Dr., Boise, Id. 83704

[21] Appl. No.: 295,005

[22] Filed: Jan. 9, 1989

Related U.S. Application Data

[63] Continuation of Ser. No. 72,014, Jul. 8, 1987, abandoned.

[51] Int. Cl.[5] ..... B30B 1/18

[52] U.S. Cl. ..... 100/102; 100/229 A; 100/214; 100/287; 100/294

[58] Field of Search ..... 100/287, 102, 214, 53, 100/229 A, 226, 293, 294

[56] References Cited

U.S. PATENT DOCUMENTS

| | | | |
|---|---|---|---|
| 3,714,890 | 2/1973 | Moon | 100/287 X |
| 3,842,729 | 10/1974 | Mandrup | 100/287 X |
| 3,863,561 | 2/1975 | Karls | 100/287 X |
| 4,147,100 | 4/1979 | Dykstra | 100/52 |
| 4,275,651 | 6/1981 | Groth | 100/294 X |

*Primary Examiner*—Andrew M. Falik
*Attorney, Agent, or Firm*—Nies, Kurz, Bergert & Tamburro

[57] ABSTRACT

A removable, self-powered trash compactor particularly suited for aircraft tray carts. The compactor includes a rechargeable battery to power a motor that drives a screw drive connected with a scissor type extension linkage attached to a platen designed to permit the passage of liquids around said platen to minimize pressure exerted on walls and floor of container, carts and carriers. The food service tray guides support a plastic or fiberboard sheet to restrain resilient waste matter from returning to its original shape and permitting a disposable flexible liner to interfold underneath the compactor and surround the compactor until the first cycle wherein the liner unfolds and encompasses the cart, carrier or container space, thereby obtaining the compactor to support the disposable liner and permitting the fitting of an interfolded cover over the entire compactor inside the liner to permit the compactor to compress waste and keep waste matter from contact with the compactor mechanisms.

3 Claims, 2 Drawing Sheets

4/4

TRASH COMPACTOR ADAPTED TO BE SLIDABLY POSITIONED IN A CONTAINER

This application is a continuation, of application Ser. No. 07/072,014, filed 7/8/87 now abandoned.

BACKGROUND OF THE INVENTION

The Present invention is directed to a waste compactor device assembly of the platen type exemplified by U.S. Pat. No. 2,293,520 to J. Starr dated Aug. 18, 1942; 3,772,984 and 3,863,561 to R. Karls on Nov. 20, 1973 and Jan. 12, 1975 respectively; Re. 30,509 to R. Peterson dated Feb. 10, 1981.

Airlines have a problem in disposing of refuse over from food and beverages served to passengers. Aircraft manufacturers, airlines and foodservice providers have long desired improvements in foodservice waste handling on commercial aircraft.

Trash compactors have taken many forms and have been the subjects of numerous proposals for use in commercial, in foodservice waste handling on commercial aircraft.

Food and drink containers, napkins and utensils are compactly stored prior to the passengers being served, but must be quickly disposed of after the passengers are served, and cannot be carefully stacked.

Consequently, the volume required for disposing of all such refuse is much greater than the volume which the refuse occupied prior to use.

Studies have demonstrated that between 27–43% of waste (by volume) is not accomodated after airline food or beverage service.

Food and drink containers made of plastic and certain paper products had a "memory" and after the compacting cycles of piror art compactors, the resilient products would return to their original shapes. This failure mode reduced the amount of waste matter that could be placed into the waste containers.

Another major problem that has plagued passenger carriers in the aircraft field is the problem of leaking waste bags damaging floor coverings and etching or corroding the floor panels. Frequently waste bags have to be placed on the floor of the aircraft due to unavailable space in carts, bins or other approved containers. Floor panels and carpets have had to be replaced frequently due to this problem.

Working components of prior art compactors including electric motors, hydraulic fluids, pumps, fluid containers, pneumatic hoses, valves and the like typically require up to 50% or more of the space inside the waste container housing. Further considerations include the cost of flying the additional weight of such components. These factors minimize the economy of purchasing, maintaining and operating a prior art compactor for commercial flights.

In any aircraft there is a limit to the amount of floor loading that can be utilized. The weight of prior art compactors limits the amount of waste they can safely hold.

As a result of these considerations it is considered that there is a definite need to improve the manner in which foodservice waste can be compacted on commercial and other aircraft flights. It is also considered that this need is related to an economic need to handle the food and beverage waste service problem in such a manner so as to conserve passenger-carrying space within the aircraft, in such a manner as to tend to minimize the amount of labor necessary to accomplish such service.

SUMMARY OF THE INVENTION

The present invention improves on the prior art in several significant particulars. This invention relates generally to trash compactors and more particularly relates to apparatus for compacting trash in commercial and private aircraft.

More particularly, the present invention resides in the provision of a small, lightweight, self-powered compactor having a removeable, rechargeable battery to provide independent power for several compactions before being recharged.

It is a principal object of the present invention to provide waste loading either from the front of the container, cart or carrier; through a top reclosable door, a cut-away door in the top portion of the front container door or providing a hinged work top in which the compactor is inserted that opens exposing the entire container and compacted waste.

It is another object of the present invention to provide an enlargeable, self-contained, independently-powered compactor drive unit offering expandable length and width dimensions, selectable to fit various aircraft or other food service related carts, carriers or containers.

It is a further object of the present invention to provide a box-shaped bag, bin or box that offers a lightweight, high strength disposable or re-usable waste container.

It is another object of the present invention to utilize the tray holders in foodservice carts as memory retention devices to prevent "bounce back" of resilient waste matter.

It is an important feature of the present invention to permit liquids contained to flow around the platen while compressing the waste products, reducing the laborious task of attempting to separate liquids before placing waste in garbage disposal containers or compactors. Present art compactors require separation of liquid and tests have shown that they will expell liquids into the interior of the cabin or sometimes burst the bottom holding pan of the container It is an object of the present invention to eliminate aircraft power interface requirements encountered by prior art compactors. Prior art compactors require a power interface with galleys or airflame and mandate specific functional locations. This presents a problem when galleys need to be moved to change passenger configurations. Modifications of wiring, piping, hoses and tubing that interface with prior art type compactors is expensive and time consuming.

Another object of the invention to permit the compactor system to retrofit easily into present and future foodservice containers, carts, and waste containers without major container modifications. This feature permits converting a foodservice cart into a waste container or compactor cart after meal or beverage service.

A further object of the invention is to eliminate damage to floor panels and floor coverings by providing sealed containers for garbage stowage. This feature eliminates the need to stow the filled waste bags in the interior of the cabin by maintaining placement in a sealed container and liner.

Another object is to limit space required for the compactor unit. Prior art compactors typically require 30–50% of the space available in the container. The present invention improves on the prior art by requiring less than 10% of the space inside a standard state-of-the-art foodservice or waste container.

An additional object of the invention is to permit a slideably removeable compactor from the container without any special knowledge, effort or tools to permit maintenance, cleaning or repair.

An object of the present invention is to provide a pre-installed disposable, lightweight, flexible waste liner of high strength material that permits repeated compacting cycles without having to empty the container. This allows the aircraft personnel to reduce labor intensive tasks required in replacing liners as well as providing a fire resistant container to house the compacted waste.

An additional object of the present invention resides in the provision of a flexible, disposable liner. Said liner completely surrounds the compactor. covers the top of the compactor in a hooded mode. The hooded liner is suspended by the compactor at its uppermost end. An opening for passage of waste into the liner is cut either in the front or top of the liner dependent upon the selected mode of compactor use.

A further object of the present invention is to furnish a pre-fold and packaged liner that permits sliding of the compactor into a slot at the uppermost end when preparing the compactor to be slidably placed into a cart, carrier or other container. Secondarily, small strips of tape are used to temporarily suspend the accordion folded liner in a tightly packaged unit to the underside of the compactor. The tightly packaged compactor, liner and platen cover require less than 3 inches of space and permit food, beverage or other in-flight provisions to be placed below the compactor module prior to actual compactor use.

Another object of the present invention resides in the provision of an initial cycle of the compactor to unfold the liner and automatically release the folds from the tape by pressing the cycle button and permitting the platen to push the liner to most extended position. The tape is loosened allowing the liner to fill the cart, carrier or other waste holding compartment.

An additional object of the present invention resides in the provision of a selectable pressure level, distance of platen travel and speed of compaction to permit reversing of the platen and scissor direction when a pre-selected pressure is reached. Further, a limit switch provides directional change when the platen has extended to its outermost position. Also, a pre- selector is provided to switch the speed by changing to a higher or lower gear for either a more rapid compacting cycle or a slower more powerful compacting cycle.

A further object of the present invention is provided by using the tray guides in a standard foodservice cart to hold resilient compacted waste in its compacted mode and preventing "bounce-back".

Another object of the present invention is to provide a semi-rigid sheet of plastic, cardboard or other resilient material to be pressed against the waste matter, if required to hold the compressed waste in place and restrain waste products with "memory" or "bounce-back" from returning to its original uncompacted shape. ment.

A further object of the present invention is provided by a small high strength cover that is placed over the platen and extending upward to cover the entire compactor, foldably containing enough material to permit the platen and scissor linkage to travel to its fully extended position. During the compacting cycles this cover prevents liquid matter, food particles or other compacted waste from contaminating or soiling the platen, scissor, drive unit or underside of the comactor module. When the waste is removed from the aircraft at the end of the flight, the cover is removed with the liner. This keeps the entire cart, carrier or container as well as the compactor components clean and assists in maintaining asepsis control.

A still further object of the invention is to permit the liquid waste to be placed into the liner while the foodservice material is being compacted. The compactor permits the liquids to flow upward and around the platen without attemping to pressurize the liquid. Offering the flight attendants the advantage of not having to pour out the liquid prior to compacting is a distinct labor saving advantage as well as providing a more sanitary working condition.

BRIEF DESCRIPTION OF THE DRAWINGS

FURTHER OBJECTS WILL APPEAR FROM THE FOLLOWING DESCRIPTION OF THE ACCOMPANYING DRAWINGS HEREIN.

DESCRIPTION OF THE PREFERRED EMBODIMENTS

Figure 4:
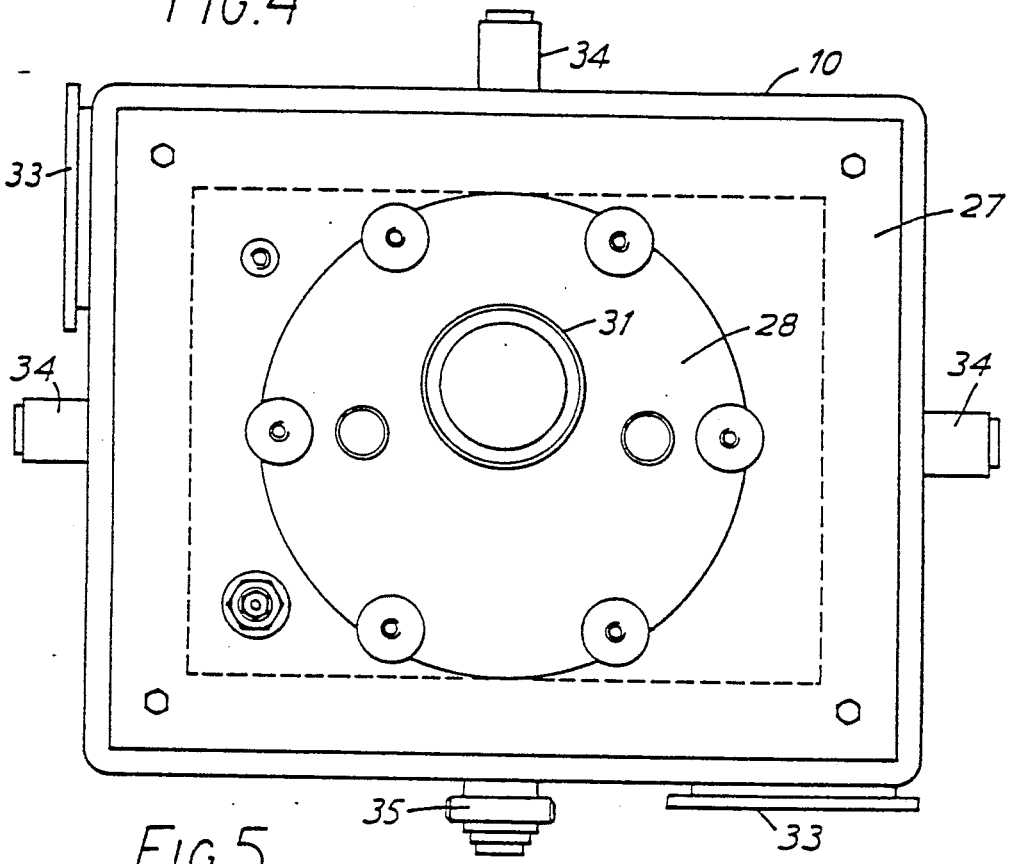
FIG. 4 is a front elevational view of the compactor inserted into a cart and surrounded by an interfolded liner that is secured for unit storage.

With continued reference to the drawings wherein the same reference numerals are employed throughout the several views to indicate the same parts, the numeral 1 designates in general a self-contained, independently powered, aircraft trash compactor housing. The compactor is composed of five principal parts, housing 1, a motor 9 housed in a receptacle 9*a*, an acme threaded rod screw drive 8, a rechargeable battery 7, a scissor linkage 13 connected to a platen 17, and an interfolded disposable waste liner or bag 23. The compactor is operable by actuating power switch 2 and start button 4.

The invention may be embodied in other specific forms without departing from the spirit or essential characteristics thereof. The present embodiment is therefor to be considered in all respects as illustrative and not restrictive, the scope of the invention being indicated by the appended claims rather than by the foregoing description, and all changes which come within the meaning and range of equivalency of the claims are therefore intended to be embraced therein.

Figure 2:
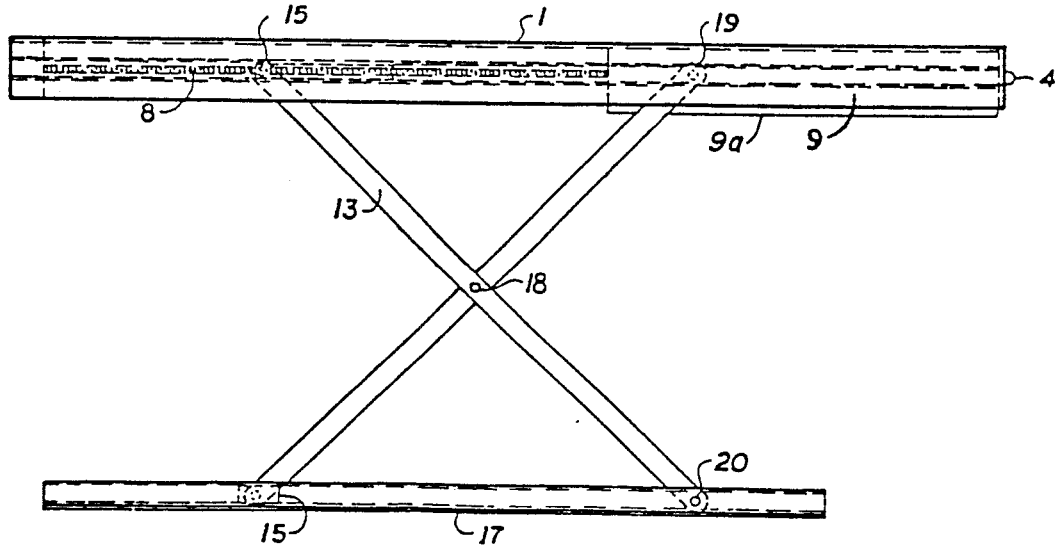
FIG. 2 is a side elevational view of the compactor in operative extended positon while removed from waste container.

The compactor housing 1 in FIG. 2, in its practical embodiment occupies less than 3 inches when retracted. It can be extended up to 30 inches or more, depending upon the size of the cart, carrier or container within which it is placed for service.

The width or reach of the housing 1 can be easily enlarged by any suitable means (not shown).

Figure 1:
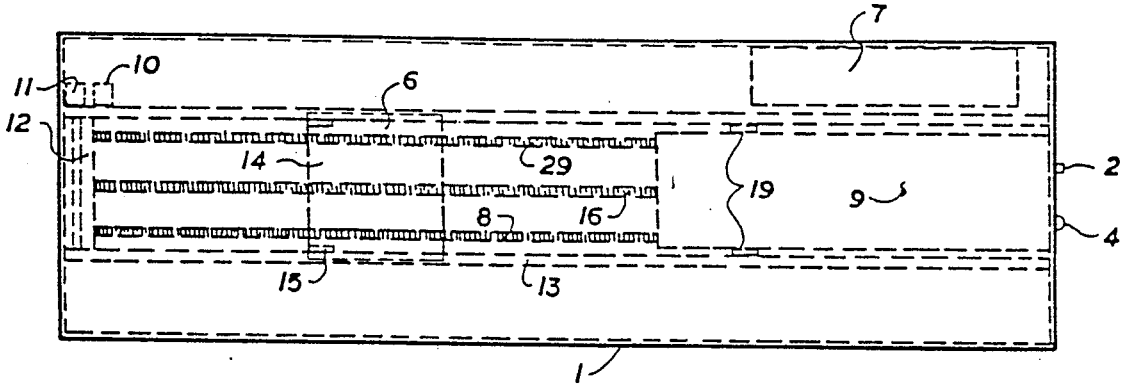
FIG. 1 is a top plan view of the compactor.
Figure 3:
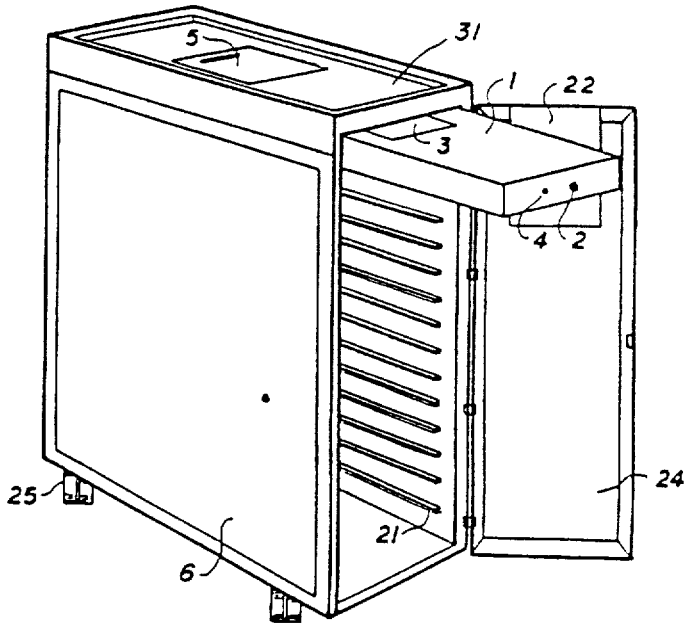
FIG. 3 is a perspective view of the compactor partially inserted into a tray receptacle.
Figure 4:
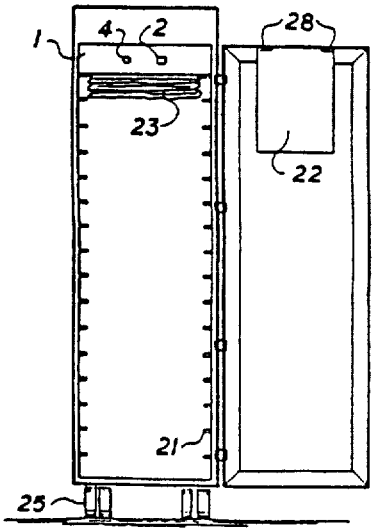
Figure 5:
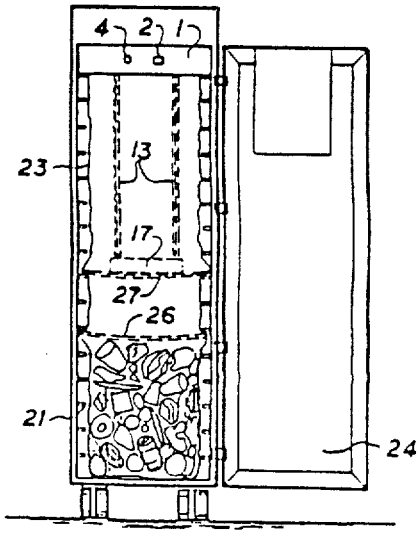

For cleaning servicing and inspection, the compactor can be slidably removed (FIG. 3). While removed, it can be actuated, extending the scissor linkage 13 operating over a fulcrum 18, and extended due to the sliding of wheels with bearings or smooth glides 15 which travel in tracks 6 (FIG. 1). Pins 19 and 20 are fixed to the arms 13 and upon action by screw drive 16 and or 8 cause platen 17 to extend to its outermost limit.

The complete compactor unit is sealed to provide steam cleaning or immersion in an industrial dishwasher.

The extension linkage 13 moves platen 17 vertically until glides 15 reach limit switch 10 or achieve selected pressure and actuate pressure switch 11 that operates through a suitable control circuit (not shown) to reverse the motor 9 and cause the scissor linkage to its retracted position (FIG. 3).

A drive bar 12 (FIG. 1) operates through screw drive 16 to press glides 15 toward pins 19 and 20 to provide the vertical movement of platen 17.

The platen 17 permits liquid waste to flow above its surface (FIG. 5) to relieve excessive pressure that might damage systems while compressing frangible waste.

An inner liner 23 is placed over the platen and completely surrounds the compactor except for a cut-out section either in the front of the housing 1 (FIG. 5) for loading through the open door 24 (FIG. 3), through a small door 22 hingedly connected to door 24 by hinges 28, or through the top 5 (FIG. 3). Cover 27 protects platen 17 and scissor arms 13.

Tray holders 21 can be used to support compactor 1 on at any level, permitting storage of material. Holders 21 furnish a "hold-down" feature to keep "memory" of resilient material from returning to its original shape (FIG. 5) after being compacted. Tray holders 21 are vertically spaced on each interior sidewall of cart 30 to define a vertically spaced series of horizontally extending opposed slots that permit more than one compactor to be stored in a foodservice cart prior to foodservice. This permits several compactors to be placed into service following foodservice.

Top feeder door 5 (FIG. 3) is used to place waste through slidable slot 3 permitting waste to drop by drive screws 8. When feeder door 5 is to be used, screw drive 16 is eliminated from the system.

Figure 5:
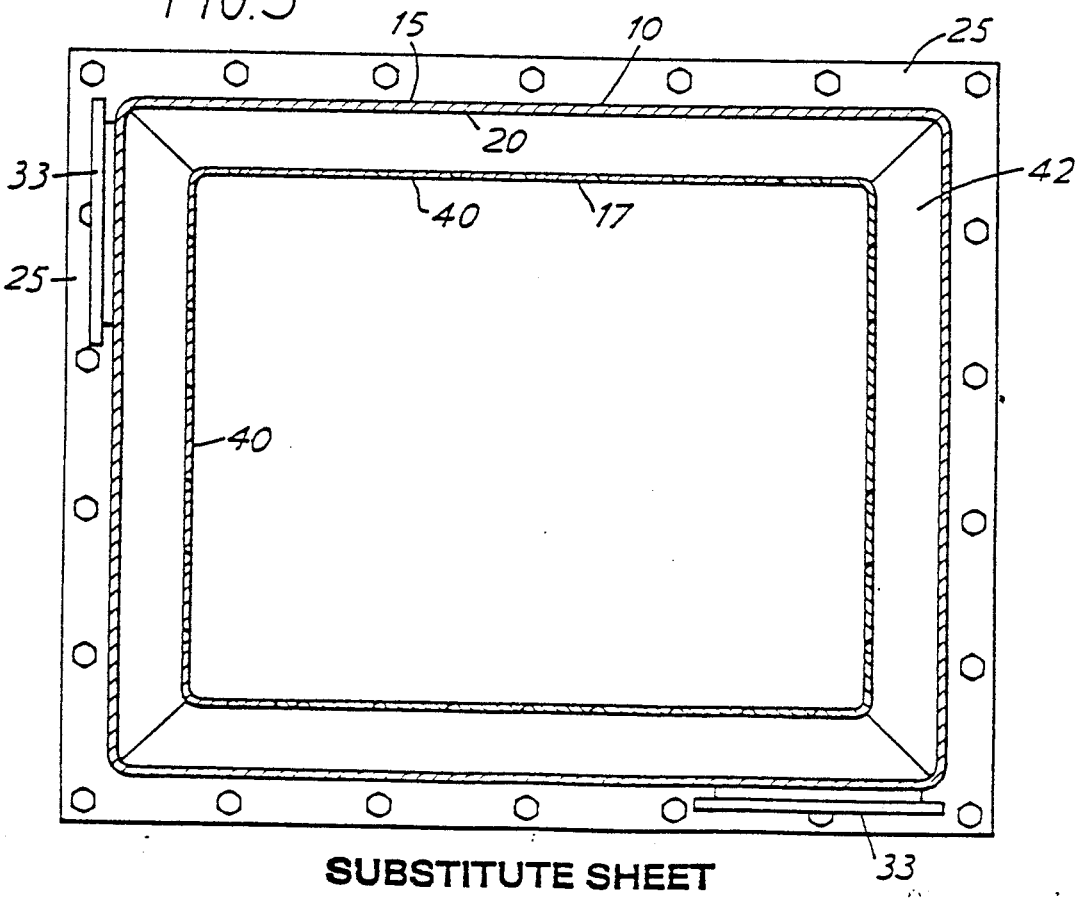
FIG. 5 is a front elevational view of an inserted compactor showing use of side tray slots as memory retainers after a compacting cycle is completed.

Entire worktop 31 (FIG. 3) can be lifted with liners attached (FIG. 5) and waste can be placed through an opening in disposable liner 23 (FIG. 5). Liner 23 is suspended from compactor 1 upon installation by attaching small pieces of tape or a band to the liner for tightly fastening liner 23 to compactor 1 (FIG. 4)

Battery 7 permits use of compactor 1 without requiring complicated task of writing to the cart 30, carrier or other receptacle, connecting the electricity to cart and moving connections whenever galley or seating is rearranged.

Liner 23 is received in an interfolded fashion (FIG. 4). Compactor is slipped into a slit in the anterior portion of the liner or bag. The upper surface of liner 23 passing over top of compactor 1 allows compactor to suspend liner prior to compacting and during compacting and waste collections. When aircraft lands, cart is removed to kitchen area and liner is replaced.

Plastic or fiberboard sheet 26 can be inserted into compactor liner 23 to engage with tray holders 21 to restrain "memory" or bounce-back of resilient materials.

I claim:

1. A portable trash compactor adapted to be slidably and removably received in a container having a laterally facing opening defining an entry means, said compactor comprising an elongated, substantially rectangular housing having a size to permit it to be laterally removably received within a pair of opposed slots formed in the inner portion of the container, the slots each having openings facing the entry means to receive the rectangular housing, a battery powered motor within adjacent one end of said housing, a drive bar supported on parallel tracks within said housing for movement toward and away from said motor, screw drive means drivingly connecting said motor and said drive bar to move said bar along said tracks, a scissors linkage carried within said housing and operably connected to said drive bar, and a platen carried by said linkage and movable thereby toward and away from said housing through a trash compacting stroke and a return stroke, whereby said compactor housing is insertable and removable laterally through the entry means in the container and is slidable along and is retained in the opposed slots within the container.

2. The trash compactor according to claim 1 together with a flexible cover extending from said housing around said platen and said linkage to isolate said compactor from trash.

3. The trash compactor according to claim 1 wherein said linkage comprises two pairs of arms, each pair comprising two arms pivotally connected at points between their ends, one arm being connected at its respective ends to said drive bar and said platen and the other arm being connected at its ends respectively with said housing and said platen.

* * * * *

UNITED STATES PATENT AND TRADEMARK OFFICE

CERTIFICATE OF CORRECTION

PATENT NO. : 5,001,977

DATED : March 26, 1991

INVENTOR(S) : Thomas R. Tracy

It is certified that error appears in the above-identified patent and that said Letters Patent is hereby corrected as shown below:

Sheet 1 of the drawings, consisting of Figs. 4 and 5, should be deleted to replaced with the sheet of drawings, consisting of Figs. 3-5, as shown on the attached page.

Signed and Sealed this

Eleventh Day of August, 1992

*Attest:*

DOUGLAS B. COMER

*Attesting Officer*

*Acting Commissioner of Patents and Trademarks*